US011578512B2

(12) United States Patent
Ge et al.

(10) Patent No.: US 11,578,512 B2
(45) Date of Patent: Feb. 14, 2023

(54) VEHICLE DOOR HANDLE ASSEMBLY

(71) Applicant: Huf Hülsbeck & Fürst GmbH & Co. KG, Velbert (DE)

(72) Inventors: Peng Ge, Novi, MI (US); Yong-Sang Cho, Novi, MI (US); Suat Kaya, Novi, MI (US); Alessandro Miri, Canton, MI (US)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 331 days.

(21) Appl. No.: 15/931,907

(22) Filed: May 14, 2020

(65) Prior Publication Data

US 2021/0355721 A1 Nov. 18, 2021

(51) Int. Cl.
*E05B 79/06* (2014.01)
*E05B 85/10* (2014.01)
*E05B 85/16* (2014.01)

(52) U.S. Cl.
CPC ..... *E05B 85/103* (2013.01); *E05B 85/16* (2013.01); *E05Y 2900/531* (2013.01)

(58) Field of Classification Search
CPC .... E05B 17/0041; E05B 17/002; E05B 77/34; E05B 77/42; E05B 85/10; E05B 85/103; E05B 85/107; E05B 81/90; Y10S 292/04; Y10S 292/31
See application file for complete search history.

(56) References Cited

U.S. PATENT DOCUMENTS 2,208,818 A * 7/1940 Schaffler ..... E05B 85/107 292/DIG. 31
2,649,322 A * 8/1953 Mack ..... E05C 1/145 292/DIG. 31

(Continued)

FOREIGN PATENT DOCUMENTS

CN 106761062 A 5/2017
CN 109983190 A 7/2019

(Continued)

OTHER PUBLICATIONS

Chinese Patent Office, First Office Action for Application No. 202110516041.6 dated Mar. 8, 2022, 8 pages.

(Continued)

*Primary Examiner* — Carlos Lugo
(74) *Attorney, Agent, or Firm* — Honigman LLP; Matthew H. Szalach; David J. Thomas

(57) ABSTRACT

A door handle assembly for a vehicle includes a housing, a handle, and a compression mechanism. The handle is rotatably attached to the housing and rotatable between a resting position and a depressed position. The compression mechanism is configured to allow rotation of the handle between the resting position and the depressed position. The compression mechanism includes a plunger and a biasing member. The plunger is coupled to one of the housing or the handle and translatable between a first position when the handle is in the resting position and a second position when the handle is in the depressed position. The biasing member is coupled to one of the housing or the handle and configured to bias the plunger between the first position and the second position.

15 Claims, 11 Drawing Sheets

(56) References Cited

U.S. PATENT DOCUMENTS

| | | | | |
|---|---|---|---|---|
| 3,508,778 | A * | 4/1970 | Legge | E05B 85/14 292/DIG. 31 |
| 4,580,821 | A * | 4/1986 | Genord, Jr. et al. | E05B 85/14 292/DIG. 31 |
| 6,799,663 | B2 * | 10/2004 | Dubach | F16F 7/09 188/322.22 |
| 7,216,402 | B2 * | 5/2007 | Nishiyama | E05B 77/42 292/336.3 |
| 10,435,926 | B2 * | 10/2019 | Brown | E05B 85/16 |
| 10,794,096 | B2 * | 10/2020 | Hamacher | E05B 5/006 |
| 10,837,197 | B2 * | 11/2020 | Kightlinger | E05B 5/003 |
| 2003/0141638 | A1 * | 7/2003 | Salice | E05F 5/02 267/71 |
| 2005/0269176 | A1 * | 12/2005 | Tomiji | E05F 5/10 188/284 |
| 2012/0205925 | A1 | 8/2012 | Muller et al. | |
| 2015/0300058 | A1 * | 10/2015 | Alexander | E05B 83/28 292/63 |
| 2018/0171686 | A1 | 6/2018 | Couto Maquieira et al. | |
| 2021/0332620 | A1 | 10/2021 | Rhein et al. | |
| 2021/0363792 | A1 | 11/2021 | Rhein et al. | |

FOREIGN PATENT DOCUMENTS

| | | | | |
|---|---|---|---|---|
| DE | 102005040761 | A1 * | 3/2007 | E05B 81/76 |
| DE | 102010056437 | A1 | 6/2012 | |
| DE | 102017101421 | A1 | 7/2018 | |
| FR | 3024173 | A1 * | 1/2016 | E05B 85/107 |
| FR | 3047037 | A1 | 7/2017 | |
| FR | 3071861 | A1 | 4/2019 | |
| FR | 3087810 | A1 | 5/2020 | |
| FR | 3101577 | A1 * | 4/2021 | E05B 77/34 |

OTHER PUBLICATIONS

European Patent Office, Extended European Search Report for Application No. 21173436.3 dated Oct. 18, 2021.

Chinese Patent Office, Second Office Action for Application No. 202110516041.6 dated Aug. 3, 2022.

* cited by examiner

VEHICLE DOOR HANDLE ASSEMBLY

FIELD

The present disclosure relates generally to vehicle door handle assemblies.

BACKGROUND

This section provides background information related to the present disclosure and is not necessarily prior art.

Some vehicles, such as automobiles, include door handles that are substantially flush with an outer surface of the vehicle body, e.g., a door panel. In such applications, the door handle may be moved to an extended or ready position relative to the vehicle body, such that a user may grasp the handle and open the door. In certain circumstances, such as when moisture accumulates on the vehicle body and the temperature is below freezing, a layer of ice may form on the vehicle body, including over the door handle. In such situations, it may be difficult for the door handle to be moved to the extended position due to the ice freezing over the door handle and the vehicle body.

SUMMARY

This section provides a general summary of the disclosure, and is not a comprehensive disclosure of its full scope or all of its features.

One aspect of the disclosure provides a door handle assembly for a vehicle. The door handle assembly may include a housing, a handle, and a compression mechanism. The handle may be rotatably attached to the housing and rotatable between a resting position and a depressed position. The compression mechanism may be configured to allow rotation of the handle between the resting position and the depressed position. The compression mechanism may include a plunger and a biasing member. The plunger may be coupled to one of the housing or the handle and translatable between a first position when the handle is in the resting position and a second position when the handle is in the depressed position. The biasing member may be coupled to one of the housing or the handle and configured to bias the plunger between the first position and the second position.

Implementations of this aspect of the disclosure may include one or more of the following optional features. In some implementations, the handle extends from a proximal end to a distal end. The handle may be rotatably attached to the housing at a location closer to the proximal end than the distal end. When the handle is in the depressed position, the handle at or near the distal end may urge the plunger to the second position and the biasing member to a compressed position. The handle may be configured to rotate from the resting position to the depressed position by a user exerting a force upon the handle at or near the distal end. The handle may be configured to rotate to an extended position where the handle is spaced from the plunger by a user exerting a force upon the handle at or near the proximal end.

In some implementations, when the handle is in the resting position, an outer surface of the handle is substantially parallel to an outer surface of the housing.

In some implementations, the compression mechanism further includes a damper secured to the plunger and configured to engage the handle. The plunger may include a central bore. The damper may be disposed in the central bore.

In some implementations, the compression mechanism further includes a plunger housing coupled to the housing and configured to receive the plunger and the biasing member. The plunger housing may include at least one tab. The housing may include at least one slot configured to receive the at least one tab to secure the plunger housing to the housing.

In some implementations, the handle is rotatable about a first axis and the biasing member is compressible along a second axis perpendicular to the first axis.

Another aspect of the disclosure provides a compression mechanism for allowing rotation of a handle between a resting position and a depressed position. The compression mechanism may include a plunger and a biasing member. The plunger may be disposed adjacent the handle and translatable between a first position when the handle is in the resting position and a second position when the handle is in the depressed position. The biasing member may be disposed adjacent the plunger and compressible between a third position when the handle is in the resting position and a fourth position when the handle is in the depressed position.

This aspect may include one or more of the following optional features. In some implementations, a damper is secured to the plunger and engaged with the handle. The plunger may include a central bore. The damper may be disposed in the central bore. The biasing member may define a central cavity. The damper and the plunger may extend into the central cavity.

In some implementations, the compression mechanism includes a plunger housing configured to receive the plunger and the biasing member.

In some implementations, the biasing member compresses from the third position to the fourth position by the plunger exerting a force upon the biasing member.

Yet another aspect of the disclosure provides a method for operating a door handle assembly for a vehicle. The method may include exerting a first force upon a distal end of a handle to move the distal end toward the vehicle. The method may also include removing the first force upon the distal end of the handle to allow the handle to return to a resting position.

Implementations of the disclosure may include one or more of the following optional features. In some implementations, the method includes exerting a second force upon a proximal end of the handle to move the handle toward an extended position.

In some implementations, the method includes applying a second force upon the distal end while moving the distal end toward the vehicle, the second force being opposite the first force.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
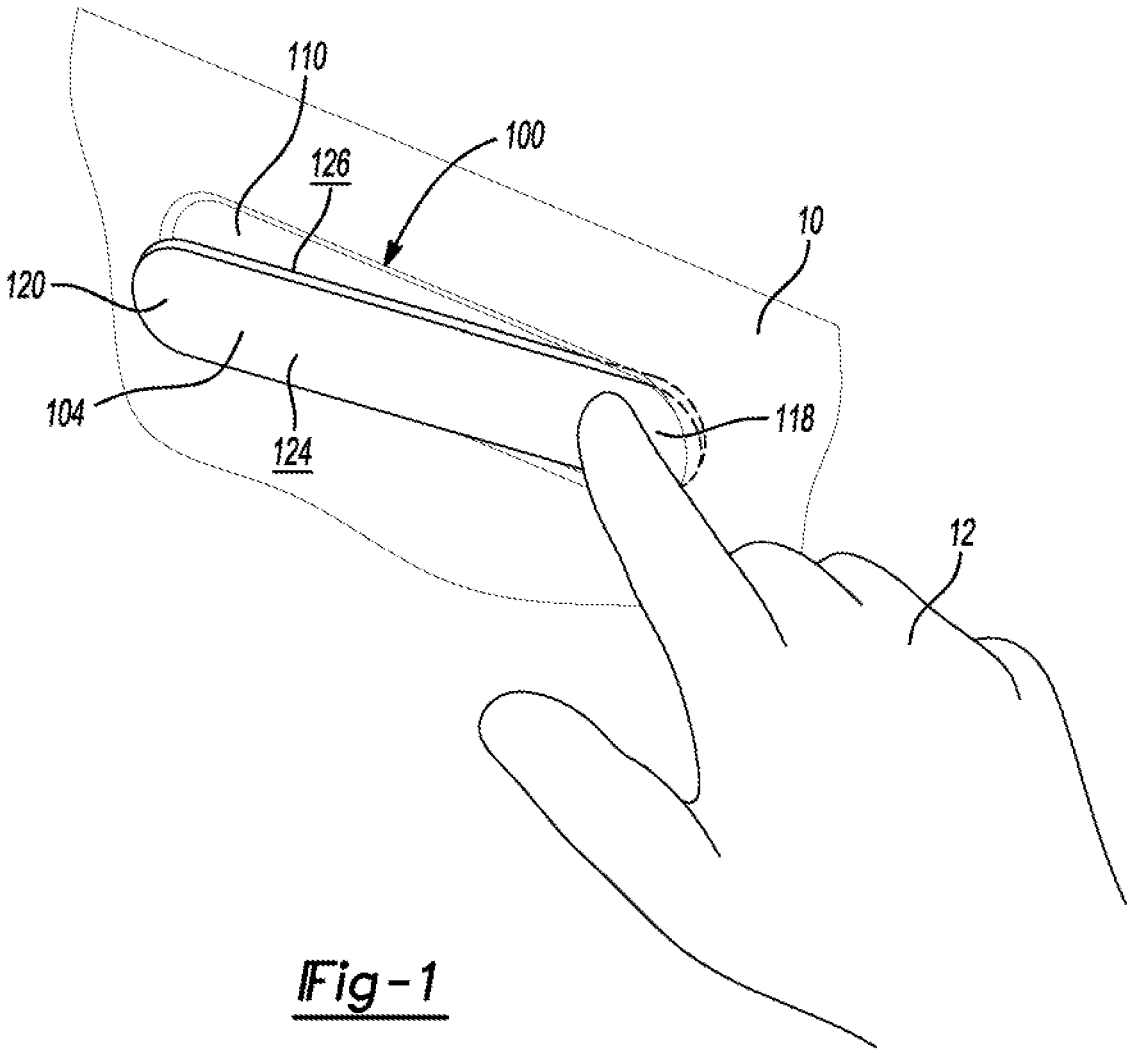
FIG. 1 is a perspective view of a user interacting with a door handle assembly installed in a vehicle body in accordance with principles of the present disclosure.

Referring to FIG. 1, a door handle assembly 100 is generally shown. The door handle assembly 100 may be installed in or attached to a vehicle, such as a door panel 10 of a vehicle body of the vehicle. In other implementations, the door handle assembly 100 may be installed in a trunk door, a hood, or any other suitable location on a vehicle. The door handle assembly 100 may facilitate opening of the door of the vehicle, and, as set forth in more detail below, the door handle assembly 100 may include certain features and functionality to allow a user 12 to break ice that has frozen over the door handle assembly 100.

Figure 2:
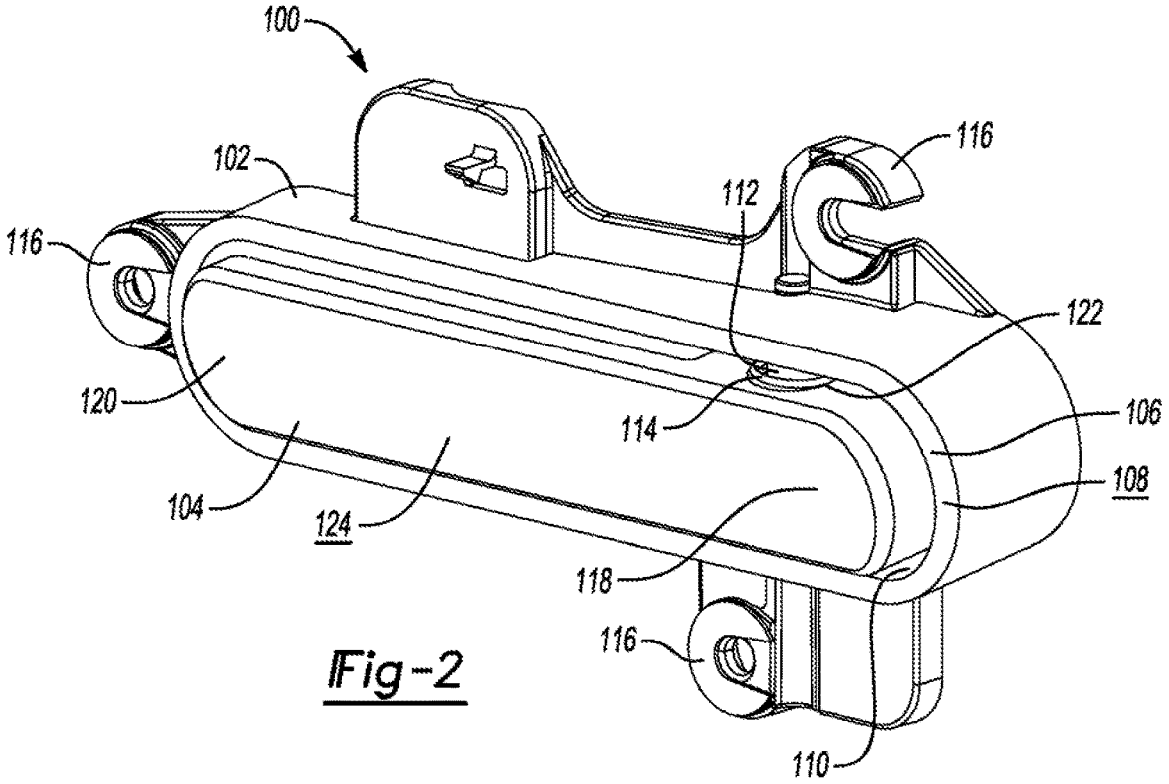
FIG. 2 is a front perspective view of the door handle assembly of FIG. 1 removed from the vehicle body.
Figure 3:
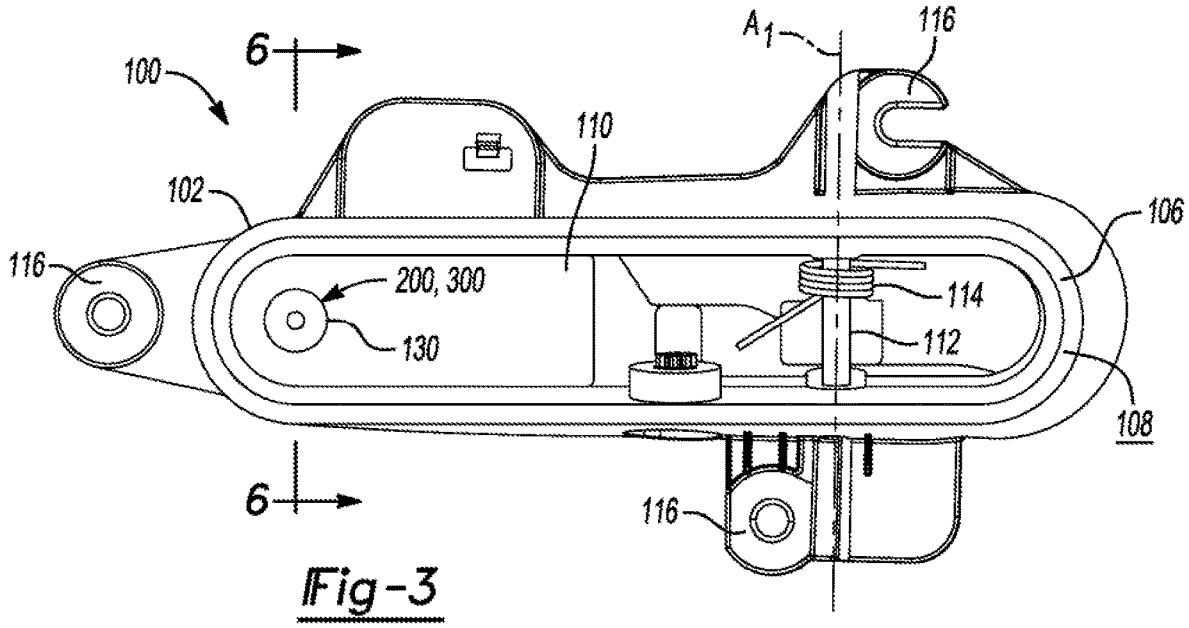
FIG. 3 is a front plan view of the door handle assembly of FIG. 1 with a handle of the door handle assembly removed for visual clarity.
Figure 4:
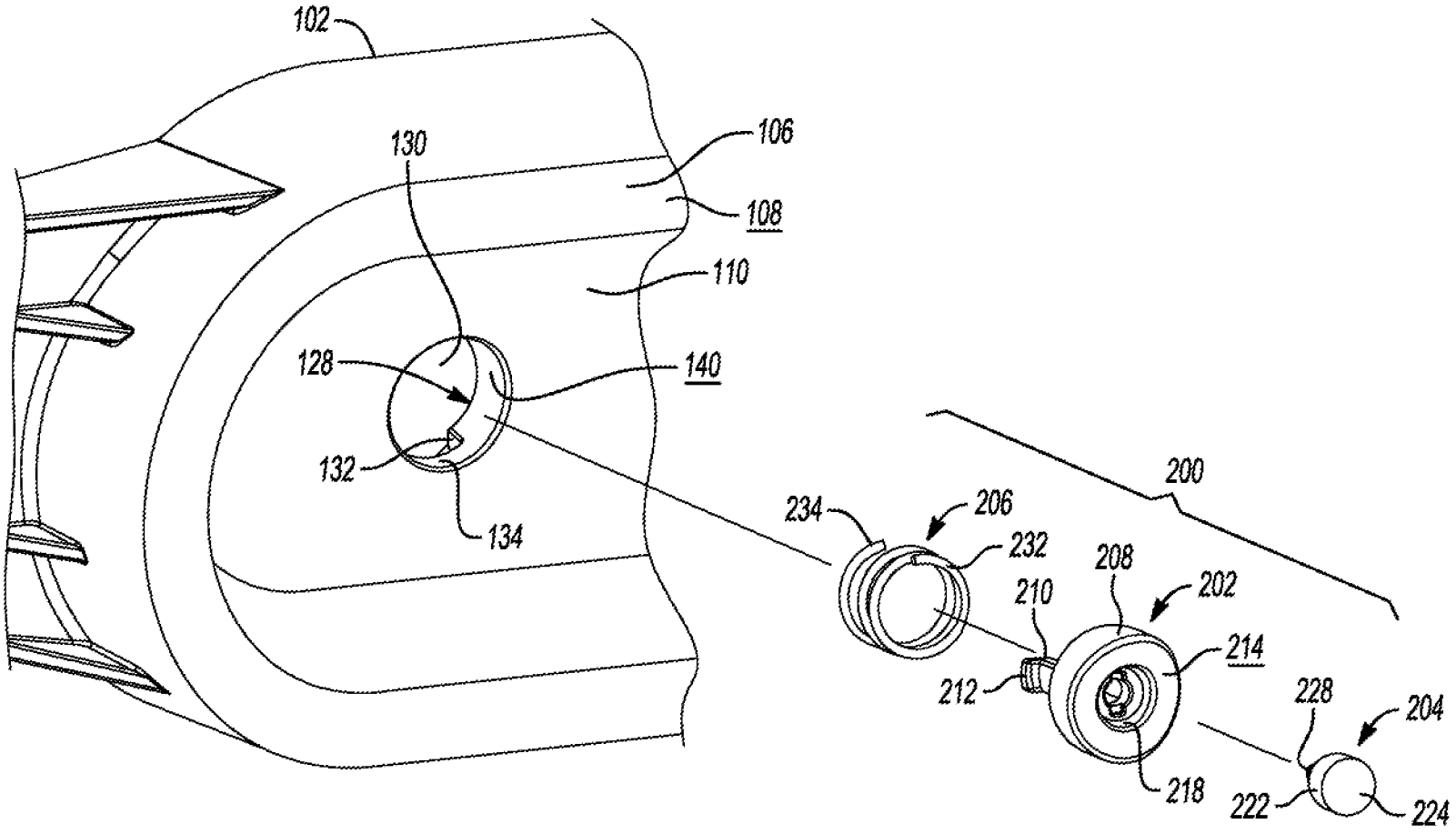
FIG. 4 is a front exploded detailed view of a first compression mechanism of the door handle assembly of FIG. 1.

Referring to FIGS. 1 and 2, the door handle assembly 100 includes a housing 102 and a handle 104. The housing 102 includes an outer rim 106 defining an outer surface 108 and a recess 110 configured to receive the handle 104. The outer surface 108 may abut a portion of the door panel 10, e.g., an inner surface of the door panel 10. The housing 102 may include a rod 112 disposed within the recess 110 and a biasing member 114 engaged with or wrapped around the rod 112. The rod 112 may define a first axis $A_1$. The housing 102 includes at least one mounting feature 116 to mount the housing 102 to the door panel 10.

Figure 11A:
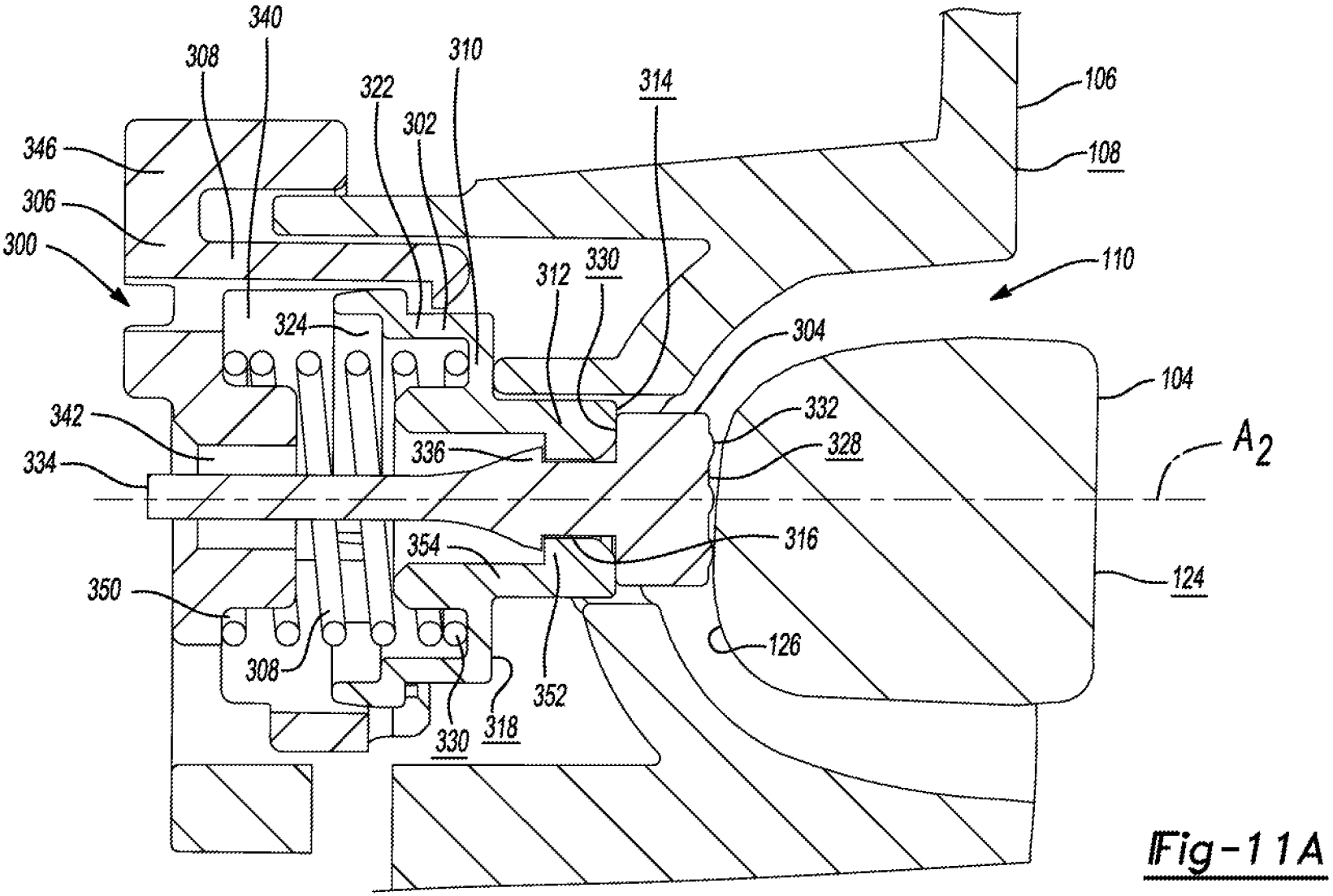
FIG. 11A is a cross-section view of the housing and the second compression mechanism of the door handle assembly of FIG. 1 taken through the line 6-6 of FIG. 3, the second compression mechanism being in a first position.
Figure 11B:
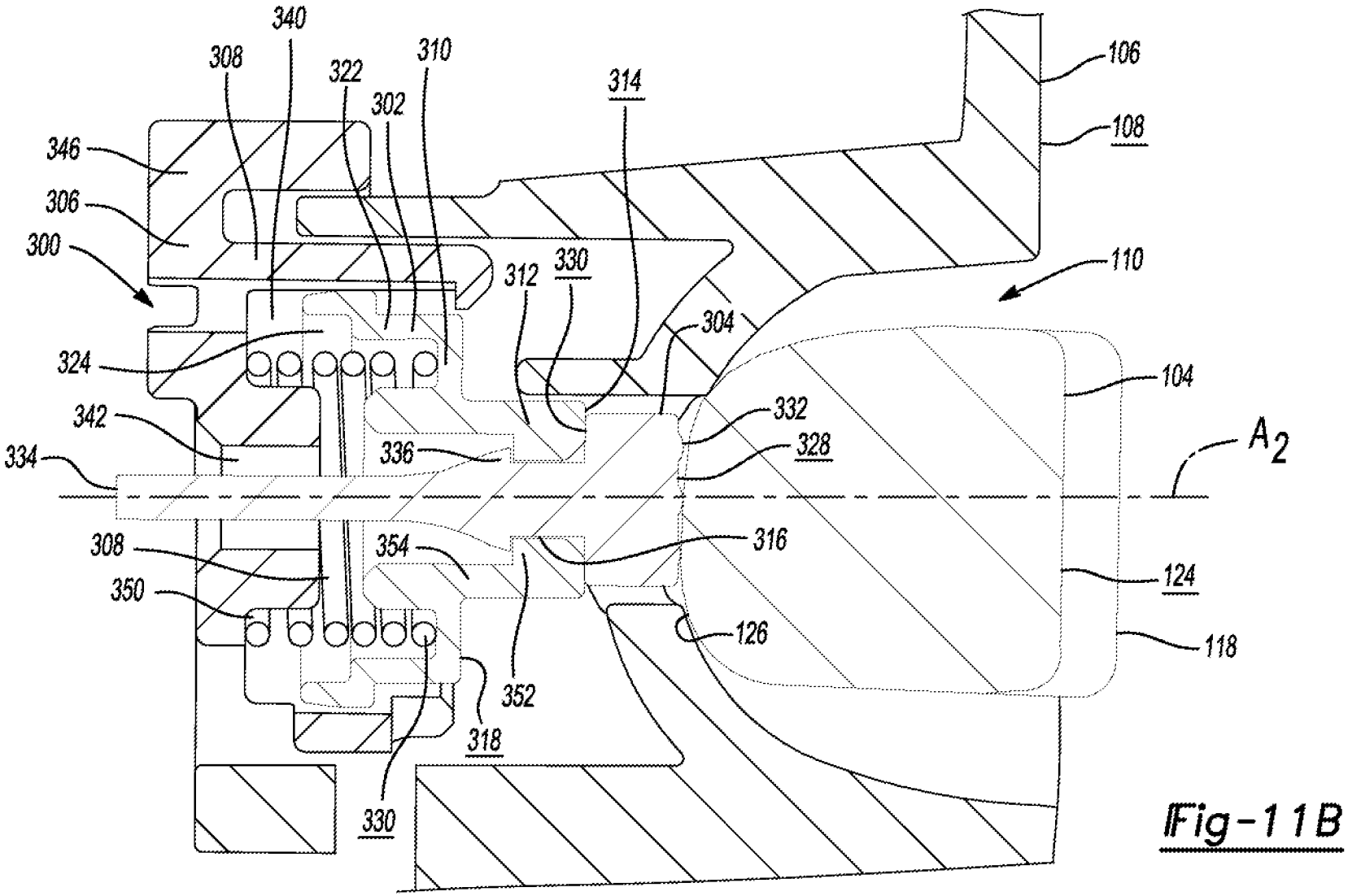
FIG. 11B is a cross-section view of the housing and the second compression mechanism of the door handle assembly of FIG. 1 taken through the line 6-6 of FIG. 3, the second compression mechanism being in a second position.

With continued reference to FIGS. 1 and 2, the handle 104 extends from a proximal end 118 to a distal end 120. The handle 104 may include an aperture 122 configured to receive the rod 112 of the housing 102. The handle 104 may rotate about the first axis $A_1$ defined by the rod 112 between a resting position (FIGS. 2, 6A, and 11A), an extended position (FIG. 1), and a depressed position (FIGS. 6B and 11B). In some implementations, the aperture 122 may be disposed closer to the proximal end 118 than the distal end 120, such that the handle 104 rotates about the first axis $A_1$ at a location closer to the proximal end 118 than the distal end 120. In some implementations, the handle 104 may be rotated between the resting position, the extended position, and the depressed position in response to a force exerted by the user 12, e.g., by the user 12 pressing against the handle 104 at or near the proximal end 118 or at or near the distal end 120. In other implementations, the handle 104 may be rotated between these positions in response to a mechanical force, electrical force, and/or electro-mechanical force exerted by a system of the vehicle, i.e., the handle 104 may be rotated without any direct contact between the user 12 and the handle 104. In yet other implementations, the handle 104 may be rotated between these positions via a force exerted by a system of the vehicle (e.g., mechanical force, electrical force, and/or electro-mechanical force) in combination with a force exerted by the user 12 (e.g., by the user 12 pressing against the handle 104), e.g., the handle 104 may be rotated from the resting position to the depressed position by the user 12 and from the resting position to the extended position by a force exerted by a system of the vehicle. The biasing member 114 may bias the handle 104 toward the resting position. In some implementations, the biasing member 114 may also be configured to retain the handle 104 in the extended position, or any other suitable mechanism may retain the handle 104 in the extended position.

The handle 104 may include an outer surface 124 that is substantially parallel to the outer surface 108 of the outer rim 106 of the housing 102 when the handle 104 is in the resting position. The handle 104 may include an inner surface 126 opposite the outer surface 124. The inner surface 126 may face the recess 110 defined by the outer rim 106. As shown in the figures, the handle 104 may include a generally rectangular shape with rounded corners; however, it should be understood that other shapes are contemplated, including rectangular, elliptical, L-shaped, circular, or any other suitable shape.

Referring to FIGS. 3-6B, the door handle assembly 100 may include a first compression mechanism 200. The first compression mechanism 200 is configured to allow rotation of the handle 104 between the resting position and the depressed position. The housing 102 includes a bracket 128 defining an aperture 130 near a portion of the recess 110 that receives the distal end 120 of the handle 104, and at least a portion of the first compression mechanism 200 is disposed within the aperture 130.

Figure 5:
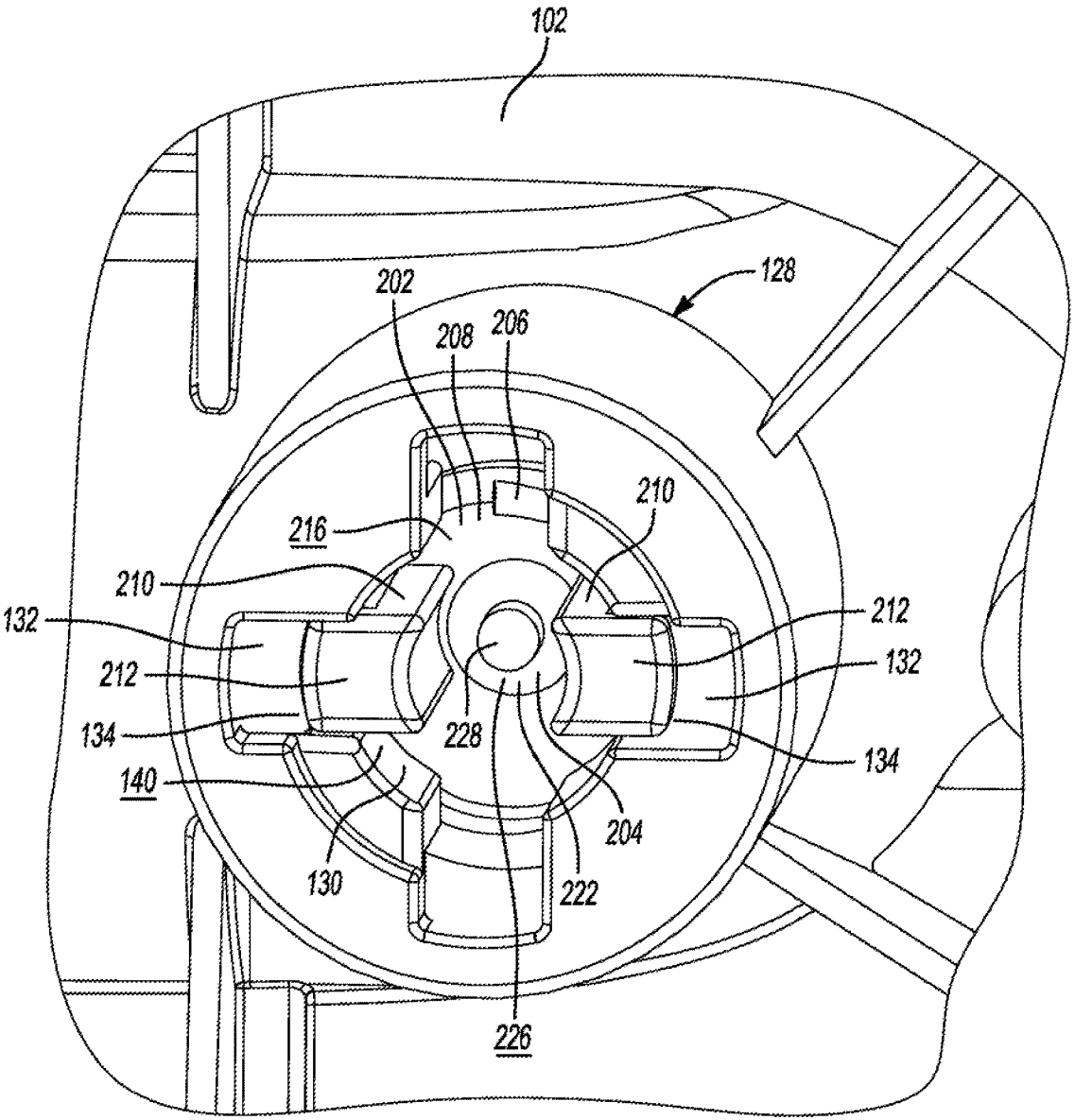
FIG. 5 is a rear perspective detailed view of a housing and the first compression mechanism of the door handle assembly of FIG. 1.

The first compression mechanism 200 includes a plunger 202, a damper 204, and a biasing member 206. In some implementations, as shown in FIG. 5, the bracket 128 may include at least one slot 132 defining a lip 134. The plunger 202 may include a body 208 and a pair of legs 210 extending from the body 208. The legs 210 may each define a catch 212 that is configured to engage with the lip 134 such that the plunger 202 is coupled to the housing 102. In other implementations, the plunger 202 may be coupled to the handle 104, e.g., the inner surface 126 of the handle 104.

Figure 6A:
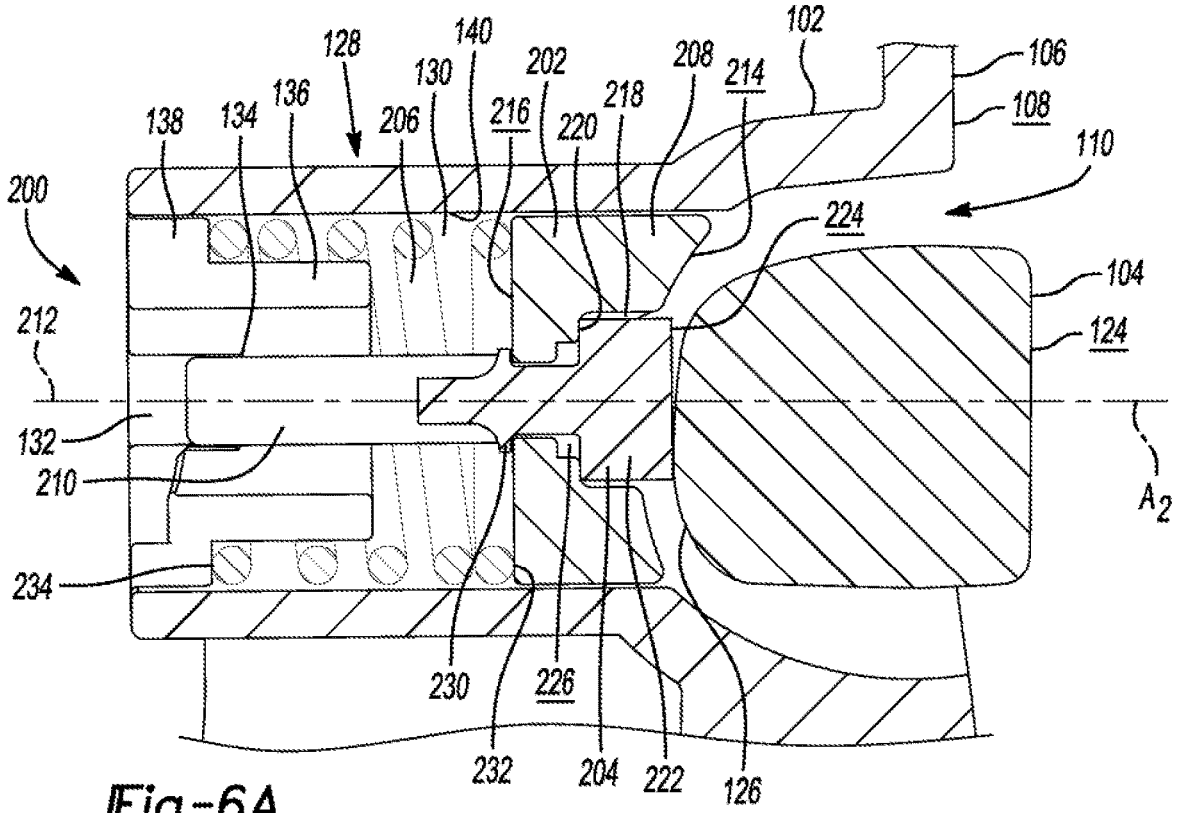
FIG. 6A is a cross-sectional view of the housing and the first compression mechanism of the door handle assembly of FIG. 1 taken through the line 6-6 of FIG. 3, the first compression mechanism being in a first position.
Figure 6B:
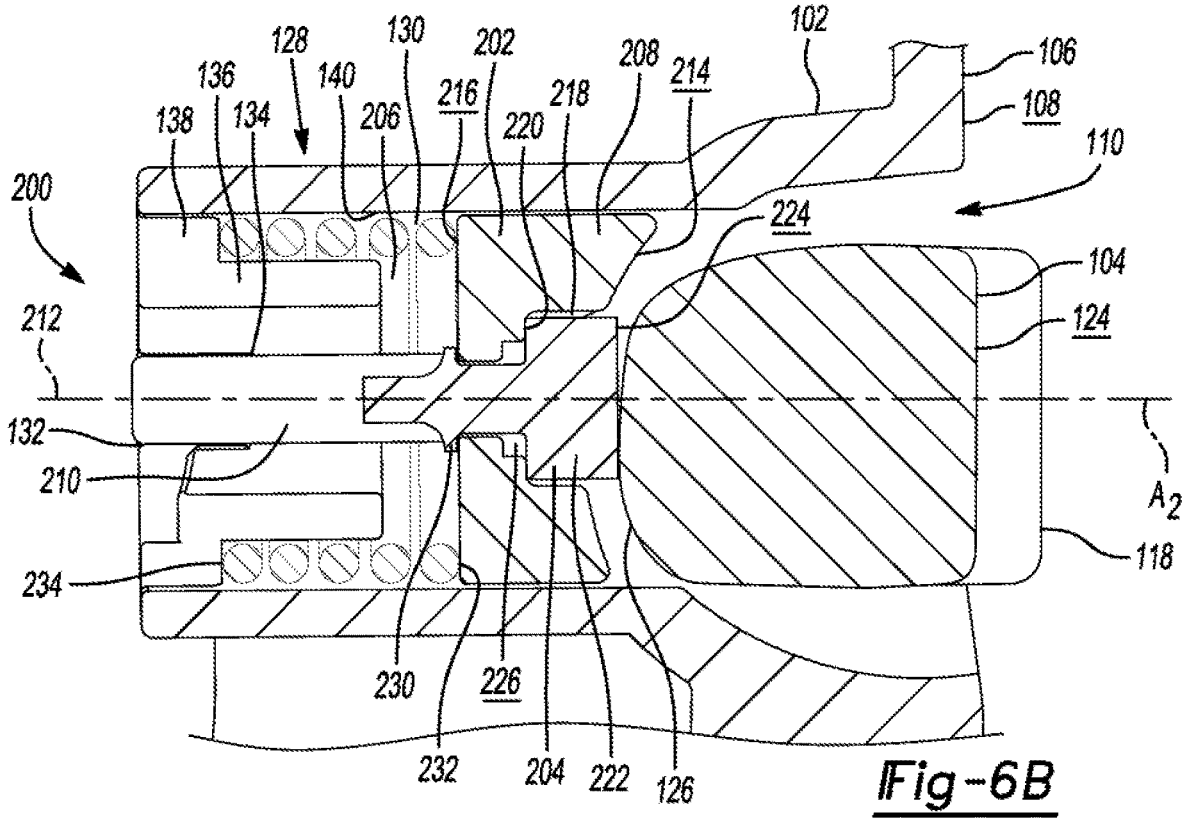
FIG. 6B is a cross-sectional view of the housing and the first compression mechanism of the door handle assembly of FIG. 1 taken through the line 6-6 of FIG. 3, the first compression mechanism being in a second position.

The body 208 of the plunger 202 may include a contact surface 214 facing the inner surface 126 of the handle 104 and an inner surface 216 opposite the contact surface 214, as shown in FIGS. 6A and 6B. The plunger 202 is translatable between a first position when the handle 104 is in the resting position (FIG. 6A) and a second position when the handle 104 is in the depressed position (FIG. 6B). In some implementations, the plunger 202 may be translatable to a third position that is further depressed than the second position, e.g., the plunger 202 may be configured to depress or compress further than the handle 104 can operate via interaction with the user 12 (or other suitable source) directly with the plunger 202 (e.g., if the handle 104 was removed). The body 208 may define a central bore 218 having a lip 220. The central bore 218 may be configured to receive the damper 204.

The damper 204 includes a body 222 defining a contact surface 224 facing the inner surface 126 of the handle 104 and an inner surface 226 opposite the contact surface 224. In some implementation, the contact surface 224 of the damper 204 may be substantially flush with the contact surface 214 of the plunger 202. In other implementations, the contact surface 224 of the damper 204 may be offset from the contact surface 214 of the plunger 202. The inner surface 226 of the body 222 may be configured to engage the lip 220 in the central bore 218 of the body 208 of the plunger 202. The damper 204 may include a stem 228 extending from the body 222, the stem 228 including a lip 230 configured to engage the inner surface 216 of the body 208 of the plunger 202, as shown in FIGS. 6A and 6B. The engagement of the inner surface 226 with the lip 220 and the inner surface 216 with the lip 230 may secure the damper 204 to the plunger 202. Accordingly, as the plunger 202 moves between the first position and the second position, the damper 204 may likewise move between the first position and the second position.

Referring to FIGS. 6A and 6B, the bracket 128 may include a central portion 136 and a flange 138 extending from the central portion 136 to engage an inner surface 140 defining the aperture 130. The biasing member 206 is disposed in the aperture 130 and extends from a proximal end 232 to a distal end 234. The proximal end 232 may engage the inner surface 216 of the body 208 of the plunger 202, and the distal end may engage the flange 138. In some implementations, the biasing member 206 may be disposed around the central portion 136 of the bracket 128, such that the biasing member 206 is coupled to the housing 102 and such that a central cavity of the biasing member 206 receives the plunger 202 and the damper 204. In other implementations, the biasing member 206 may be coupled to the handle 104, e.g., the inner surface 126 of the handle 104. The biasing member 206 may be compressible along a second axis $A_2$ defined by the aperture 130 of the bracket 128. The second axis $A_2$ is perpendicular to the first axis $A_1$. The biasing member 206 may be any suitable element, such as a spring, a compressive plastic, a compressive foam, etc.

Referring to FIGS. 7-11B, in some implementations, the door handle assembly 100 may include a second compression mechanism 300. The second compression mechanism 300 is configured to allow rotation of the handle 104 between the resting position and the depressed position. At least a portion of the second compression mechanism 300 is disposed within the aperture 130 of the bracket 128 of the housing 102.

The second compression mechanism 300 includes a plunger 302, a damper 304, a plunger housing 306, and a biasing member 308. In some implementations, the plunger 302 may be coupled to the housing 102. In other implementations, the plunger 302 may be coupled to the handle 104, e.g., the inner surface 126 of the handle 104. The plunger 302 includes a body 310 including a rim 312 extending from the body 310. The rim 312 may extend through the aperture 130, and an outer diameter of the rim 312 may be substantially equal to an inner diameter of the aperture 130. The rim 312 may include an outer surface 314 facing the inner surface 126 of the handle 104, and the rim 312 may define a central bore 316 configured to receive the damper 304. The body 310 includes a stepped outer surface 318 adjacent the rim 312 and an inner surface 320 opposite the stepped outer surface 318. The stepped outer surface 318 may engage a portion of the bracket 128, and the inner surface 320 may engage the biasing member 308.

The plunger 302 includes a radial flange 322 extending from the body 310, and the radial flange may define a catch 324 that is configured to engage a portion of the plunger housing 306. The plunger 302 is translatable between a first position when the handle 104 is in the resting position (FIG. 11A) and a second position when the handle 104 is in the depressed position (FIG. 11B). The rim 312 may include a first portion 352 having a first inner diameter and a second portion 354 having a second inner diameter greater than the first inner diameter. The first portion 352 may be configured to engage a portion of the damper 204.

The damper 304 includes a body 326 defining a contact surface 328 facing the inner surface 126 of the handle 104 and an inner surface 330 opposite the contact surface 328. In some implementation, the contact surface 224 of the damper 204 may include a plurality of protrusions or ridges 332 configured to engage with the inner surface 126 of the handle 104. The inner surface 330 of the body 326 may be configured to engage the outer surface 314 of the rim 312. The damper 304 may include a stem 334 extending from the body 326, the stem 334 including a lip 336 configured to engage the first portion 352 of the rim 312, as shown in FIGS. 11A and 11B. The engagement of the inner surface 330 with the outer surface 314 and the lip 336 with the first portion 352 may secure the damper 304 to the plunger 302. Accordingly, as the plunger 302 moves between the first position and the second position, the damper 304 may likewise move between the first position and the second position.

Figure 7:
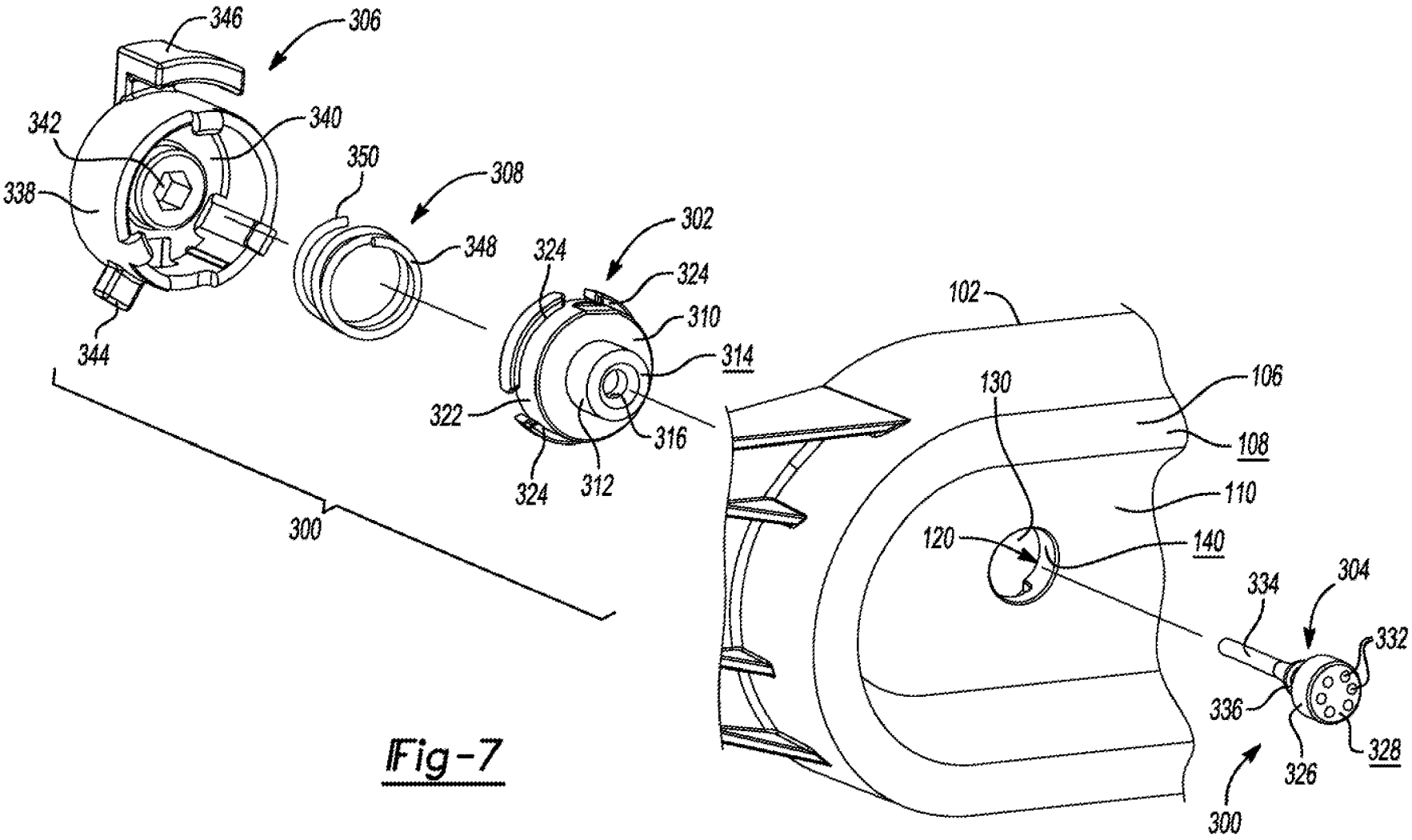
FIG. 7 is a front exploded detailed view of a second compression mechanism of the door handle assembly of FIG. 1.
Figure 8:
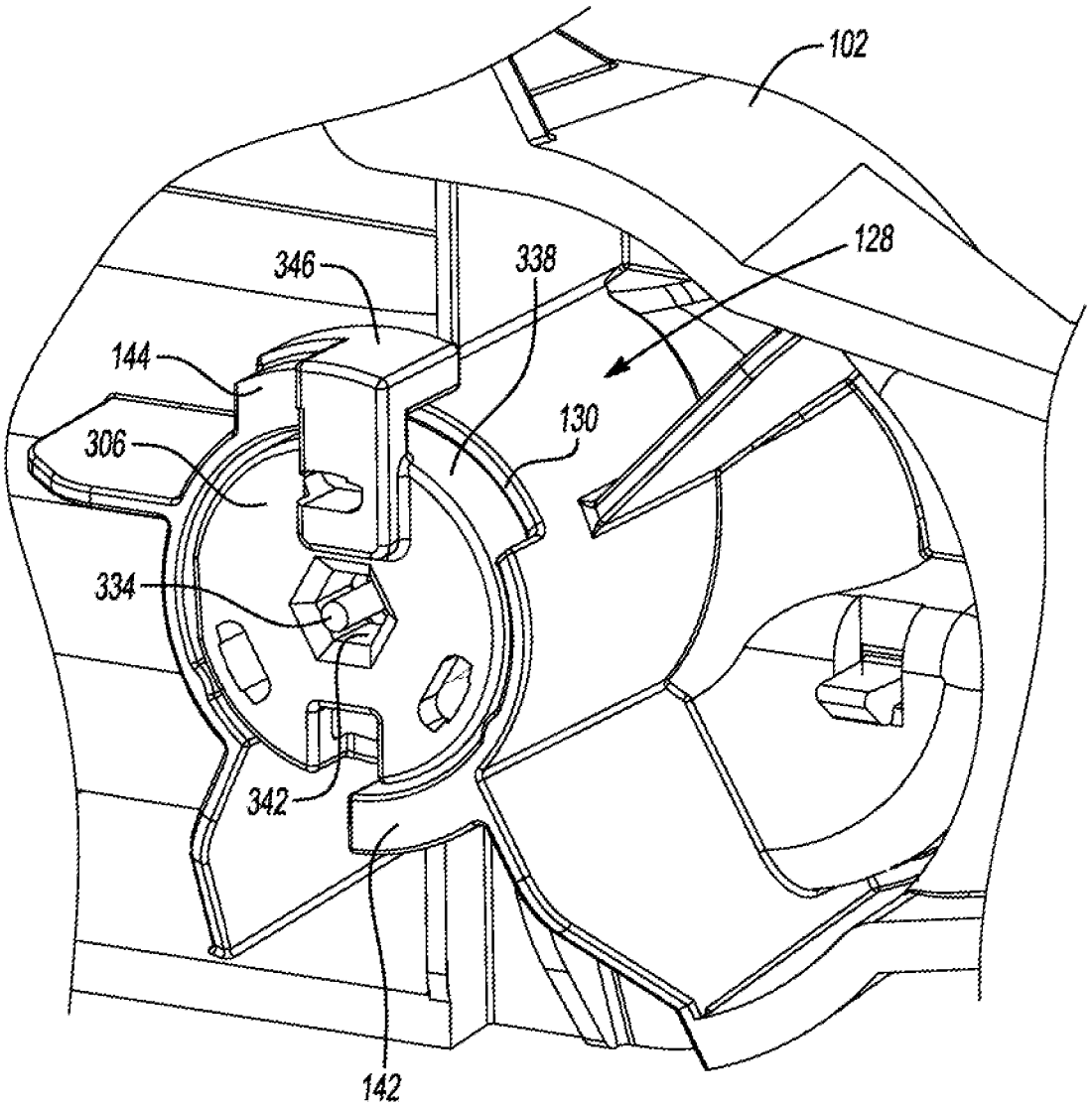
FIGS. 8-10 are rear perspective detailed views of the housing and the second compression mechanism of the door handle assembly of FIG. 1.
Figure 9:
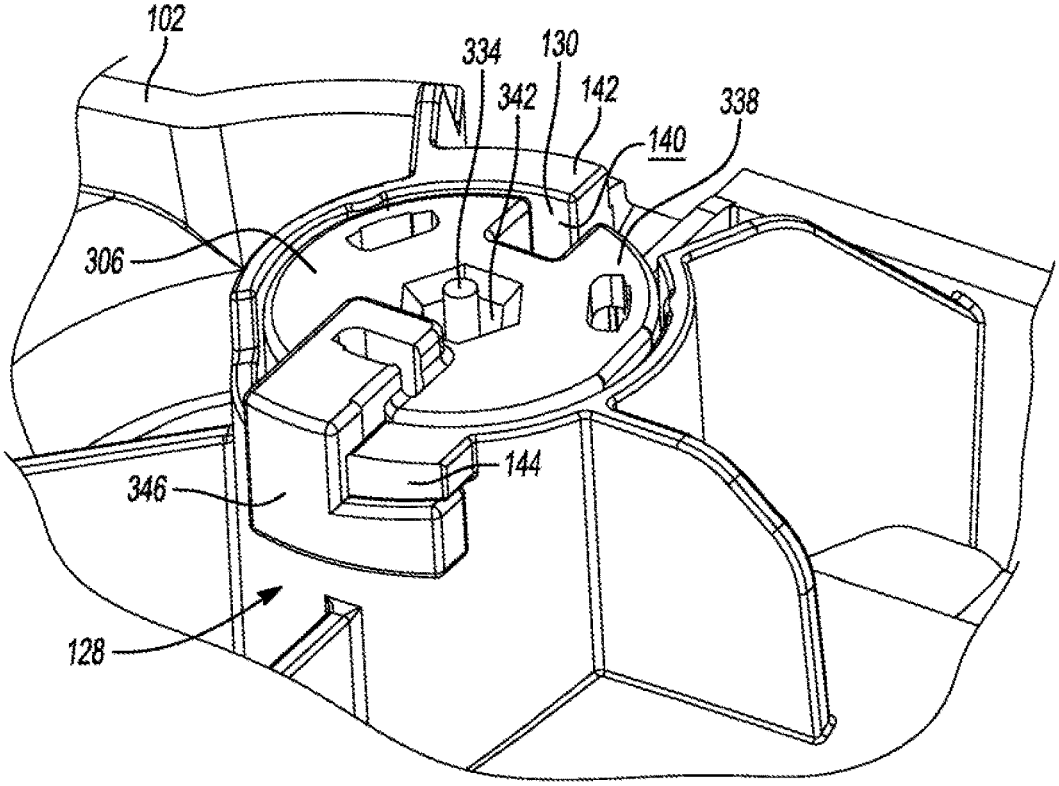
Figure 10:
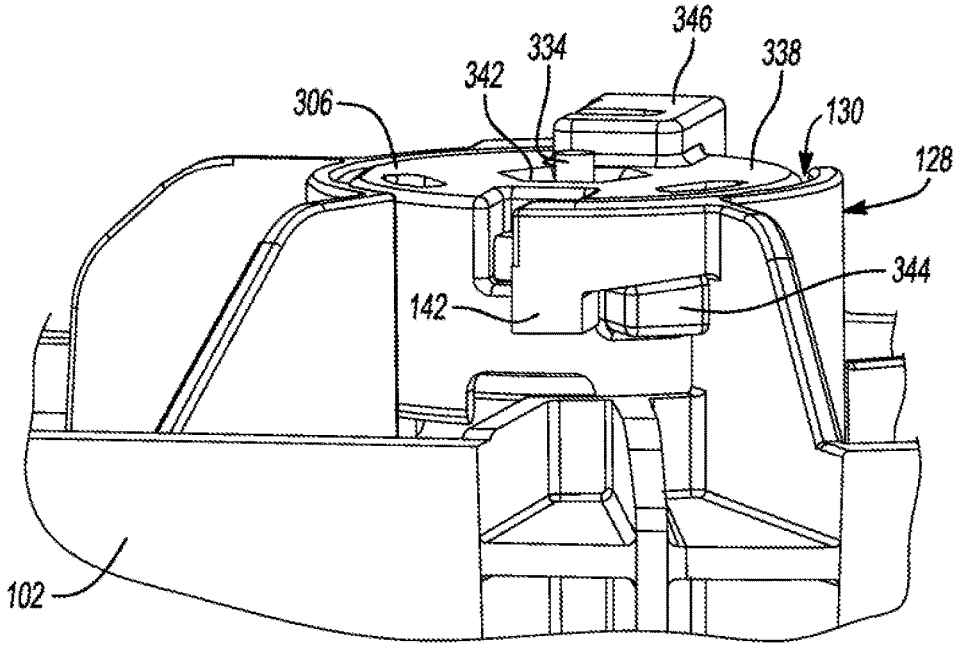

Referring to FIG. 7, the plunger housing 306 may include a body 338 defining a cavity 340 and a central bore 342. The cavity 340 may be configured to receive the plunger 302 and the biasing member 308. The central bore 342 may be configured to receive the stem 334 of the damper 304. In some implementations, as shown in FIGS. 8-10, the bracket 128 may include a first engagement member 142 and a second engagement member 144, and the plunger housing 306 may include a third engagement member 344 configured to engage the first engagement member 142 and a fourth engagement member 346 configured to engage the second engagement member 144. The engagement members 142, 144, 344, 346 may be any suitable engagement members, such as keyed slots, protrusions, catches, lips, tabs, locking mechanisms, etc. In some implementations, the first engagement member 142 may be a stepped protrusion defining a slot or recess and the third engagement member 344 may be a protrusion that is configured to engage the slot. In some implementations, the second engagement member 144 may be a protrusion and the fourth engagement member 344 may be a stepped protrusion defining a slot or recess that is configured to receive the protrusion of the second engagement member 144. The engagement of the engagement members 142, 144, 344, 346 may secure the plunger housing 306 to the housing 102.

Referring to FIGS. 11A and 11B, the biasing member 308 is disposed in the cavity 340 in the aperture 130 and extends from a proximal end 348 to a distal end 350. The proximal end 348 may engage the inner surface 320 of the body 310 of the plunger 302, and the distal end may engage the plunger housing 306. In some implementations, the biasing member 308 may be disposed around a portion of the plunger housing 306 that is secured to the housing 102, such that the biasing member 308 is likewise secured to the housing 102 and such that a central cavity of the biasing member 308 receives the plunger 302 and the damper 304. In other implementations, the biasing member 308 may be coupled to the handle 104, e.g., the inner surface 126 of the handle 104. The biasing member 308 may be disposed around the rim 312 of the plunger 302. The biasing member 308 may be compressible along the second axis $A_2$ defined by the aperture 130 of the bracket 128. The biasing member 308 may be any suitable element, such as a spring, a compressive plastic, a compressive foam, etc.

Figure 12:
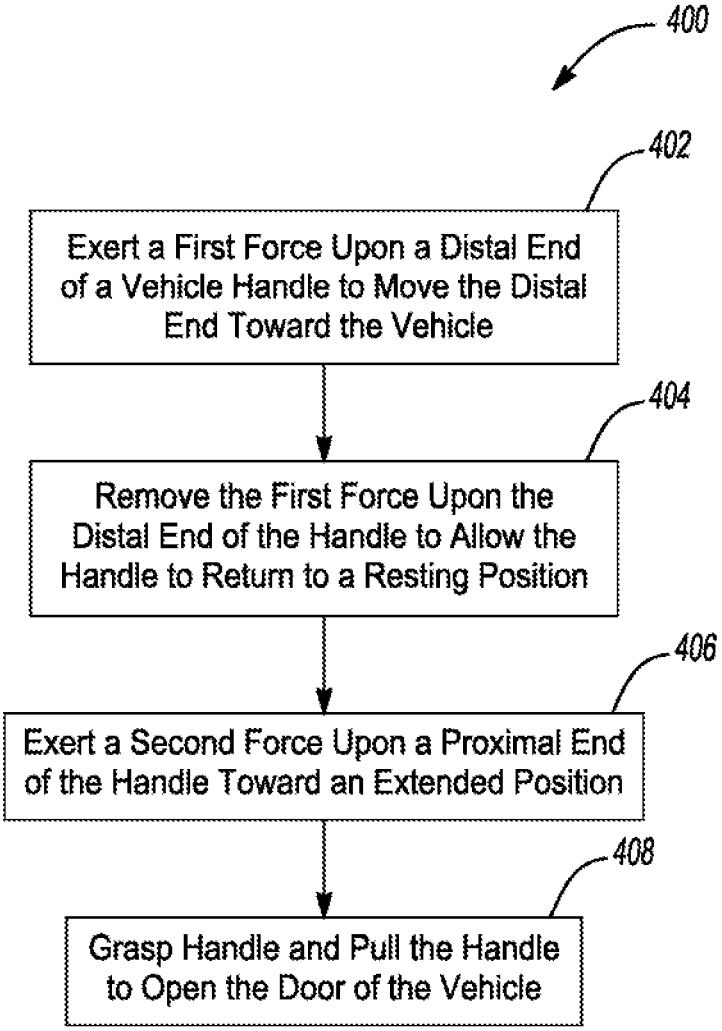
FIG. 12 is a flowchart illustrating a method for operating the door handle assembly of FIG. 1.

Referring to FIG. 12, a method 400 for operating the door handle assembly 100 is generally shown. Absent any force, the handle 104 is disposed in the resting position (FIGS. 6A and 11A), e.g., by the biasing member 114. At 402, the user 12 may exert a first force at or near the distal end 120 of the handle 104 to move the distal end 120 toward the vehicle. In other implementations, at 402, a system of the vehicle may exert the first force (e.g., mechanical force, electrical force, and/or electro-mechanical force) upon the handle 104 to move the distal end 120 toward the vehicle. At this point, the handle 104 may be in the depressed position (FIGS. 6B and 11B) and may urge the plunger 202, 302 and the damper 204, 304 toward the second position, causing the biasing member 206, 308 to move toward a compressed position. At 404, the user 12 (or system of the vehicle) may remove the first force upon the distal end 120 of the handle 104 to allow the handle 104 to return to the resting position (FIGS. 6A and 11A). At 406, as shown in FIG. 1, the user 12 may exert a second force at or near the proximal end 118 of the handle 104 to move the handle 104 toward the extended position where the handle 104 is spaced from the compression mechanisms 200, 300. In other implementations, at 406, a system of the vehicle may exert the second force (e.g., mechanical force, electrical force, and/or electro-mechanical force) upon the handle 104 to move the handle 104 toward the extended position. At 408, the user 12 may grasp and pull the handle 104 to open the door of the vehicle. It should be understood that additional and/or different steps are contemplated, and the order of the steps may vary as suitable.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed above could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A door handle assembly for a vehicle, the door handle assembly comprising:

a housing;

a handle rotatably attached to the housing and rotatable between a resting position and a depressed position; and a compression mechanism configured to allow rotation of the handle between the resting position and the depressed position, the compression mechanism comprising:

a plunger coupled to the housing and translatable between a first position when the handle is in the resting position and a second position when the handle is in the depressed position;

a damper secured to the plunger and engaged with the handle, wherein the plunger includes a central bore, and the damper is disposed in the central bore; and a biasing member coupled to the housing and configured to bias the plunger between the first position and the second position, the biasing member defining a central cavity, and a portion of the damper and a portion of the plunger extending into the central cavity.

2. The door handle assembly of claim 1, wherein the handle extends from a proximal end to a distal end, and the handle is rotatably attached to the housing at a location closer to the proximal end than the distal end.

3. The door handle assembly of claim 2, wherein, when the handle is in the depressed position, the handle at or near the distal end urges the plunger to the second position and the biasing member to a compressed position.

4. The door handle assembly of claim 2, wherein the handle is configured to rotate from the resting position to the depressed position by a user exerting a force upon the handle at or near the distal end.

5. The door handle assembly of claim 2, wherein the handle is configured to rotate to an extended position where the handle is spaced from the plunger by a user exerting a force upon the handle at or near the proximal end.

6. The door handle assembly of claim 1, wherein, when the handle is in the resting position, an outer surface of the handle is substantially parallel to an outer surface of the housing.

7. The door handle assembly of claim 1, wherein the compression mechanism further includes a plunger housing coupled to the housing and configured to receive the plunger and the biasing member.

8. The door handle assembly of claim 7, wherein the plunger housing includes at least one tab and the housing includes at least one slot configured to receive the at least one tab to secure the plunger housing to the housing.

9. The door handle assembly of claim 1, wherein the handle is rotatable about a first axis and the biasing member is compressible along a second axis perpendicular to the first axis.

10. A compression mechanism for allowing rotation of a handle between a resting position and a depressed position, the compression mechanism comprising:

a plunger adjacent the handle and translatable between a first position when the handle is in the resting position and a second position when the handle is in the depressed position;

a damper secured to the plunger and engaged with the handle, wherein the plunger includes a central bore, and the damper is disposed in the central bore; and a biasing member adjacent the plunger and compressible between a third position when the handle is in the resting position and a fourth position when the handle is in the depressed position, the biasing member defining a central cavity, and a portion of the damper and a portion of the plunger extending into the central cavity.

11. The compression mechanism of claim 10, further comprising a plunger housing configured to receive the plunger and the biasing member.

12. The compression mechanism of claim 10, wherein the biasing member compresses from the third position to the fourth position by the plunger exerting a force upon the biasing member.

13. A method for operating a door handle assembly for a vehicle, the method comprising:

exerting a first force upon a distal end of a handle in a resting position to move the distal end toward the vehicle so the handle is in a depressed position; and removing the first force upon the distal end of the handle to allow the handle to return to a resting position;

wherein the movement of the handle is enabled by a compression mechanism comprising:

a plunger adjacent the handle and translatable between a first position when the handle is in the resting position and a second position when the handle is in the depressed position;

a damper secured to the plunger and engaged with the handle, wherein the plunger includes a central bore, and the damper is disposed in the central bore; and a biasing member adjacent the plunger and compressible between a third position when the handle is in the resting position and a fourth position when the handle is in the depressed position, the biasing member defining a central cavity, and a portion of the damper and a portion of the plunger extending into the central cavity.

14. The method of claim 13, further comprising exerting a second force upon a proximal end of the handle to move the handle toward an extended position.

15. The method of claim 13, further comprising applying a second force upon the distal end while moving the distal end toward the vehicle, the second force being opposite the first force.

* * * * *